US008095296B2

(12) United States Patent
Kirstaetter et al.

(10) Patent No.: US 8,095,296 B2
(45) Date of Patent: Jan. 10, 2012

(54) PROCEDURE AND DEVICE FOR AN ADAPTATION OF A DYNAMIC MODEL OF AN EXHAUST GAS PROBE

(75) Inventors: Thomas Kirstaetter, Stuttgart (DE); Andreas Michalske, Leonberg (DE); Thomas Zein, Sindelfingen (DE)

(73) Assignee: Robert Bosch GmbH, Stuttgart (DE)

( * ) Notice: Subject to any disclaimer, the term of this patent is extended or adjusted under 35 U.S.C. 154(b) by 470 days.

(21) Appl. No.: 12/417,180

(22) Filed: Apr. 2, 2009

(65) Prior Publication Data

US 2009/0254264 A1 Oct. 8, 2009

(30) Foreign Application Priority Data

Apr. 4, 2008 (DE) ..... 10 2008 001 002
May 6, 2008 (DE) ..... 10 2008 001 569

(51) Int. Cl.
*F02D 41/14* (2006.01)
*F01N 11/00* (2006.01)

(52) U.S. Cl. ..... 701/108; 123/703

(58) Field of Classification Search ..... 701/109, 701/108, 102; 123/703; 60/274, 276, 285
See application file for complete search history.

(56) References Cited

U.S. PATENT DOCUMENTS 4,878,381 A * 11/1989 Moser et al. ..... 73/114.73
5,085,197 A * 2/1992 Mader et al. ..... 123/520
5,533,493 A * 7/1996 Atanasyan ..... 123/698
2010/0037683 A1* 2/2010 Barnikow et al. ..... 73/114.72

FOREIGN PATENT DOCUMENTS

DE 10245161 A1 * 4/2004
DE 102 60 721 7/2004

* cited by examiner

*Primary Examiner* — Hieu T Vo
(74) *Attorney, Agent, or Firm* — Merchant & Gould P.C.

(57) ABSTRACT

The invention concerns a procedure and a device for an adaptation of a dynamic model of an exhaust gas probe, which is a component of an exhaust pipe of a combustion engine and with which a lambda value is determined for regulating an air-fuel composition, whereby a simulated lambda value is calculated parallel to that in a control unit or in a diagnosing unit of the combustion engine and an application function uses the simulated and the measured lambda value. According to the invention it is thereby provided that a jump behavior of the exhaust gas probe is determined during a running vehicle operation by evaluating a signal change at a stimulation of the system and that the dynamic model of the exhaust gas probe is adapted with the aid of these results.

12 Claims, 2 Drawing Sheets

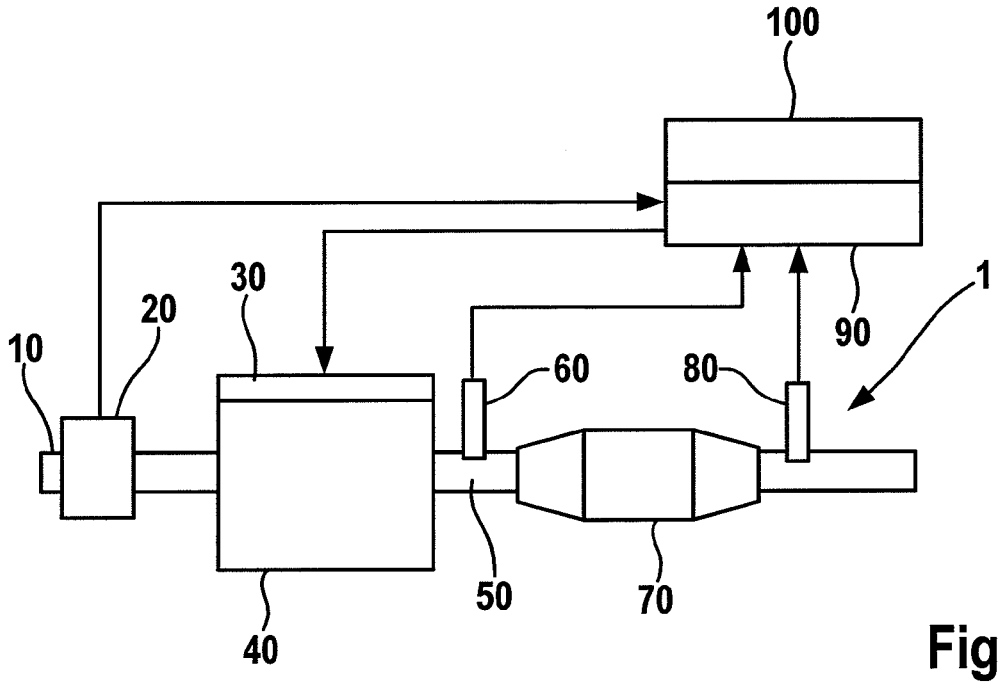
Fig. 1
Fig. 2
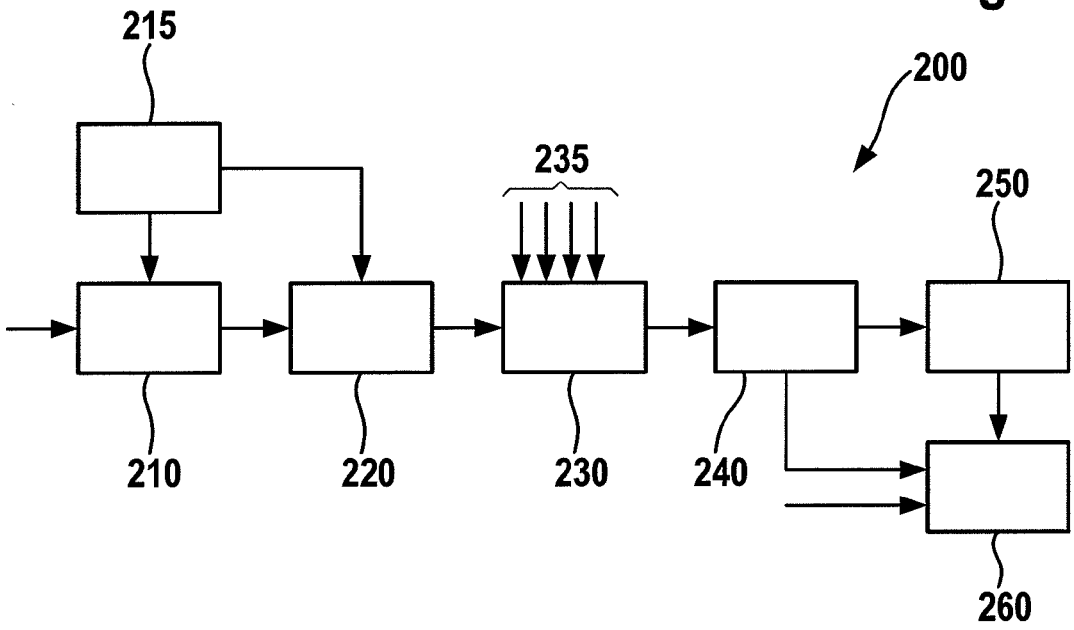

PROCEDURE AND DEVICE FOR AN ADAPTATION OF A DYNAMIC MODEL OF AN EXHAUST GAS PROBE

TECHNICAL FIELD

The invention concerns a procedure and a device for an adaptation of a dynamic model of an exhaust gas probe, which is a component of an exhaust pipe of a combustion engine and with which a lambda value is determined for regulating an air-fuel composition, whereby a simulated lambda value is calculated parallel to that in a control unit or in a diagnostic unit of the combustion engine and an application function uses the simulated and the measured lambda value.

BACKGROUND

A lambda regulation in connection with a catalytic converter is nowadays the most efficient exhaust gas purification procedure for the Otto engine. Only in combination with nowadays present ignition- and injection system very low exhaust gas values can be achieved.

Particularly efficient is the use of a three-way or selective catalytic converter. This catalytic converter has the feature to reduce hydrocarbons, carbon monoxide and nitrous oxides up to more than 98%, if the engine is operated in a range of about 1% around the air-fuel ratio with $\lambda=1$. The lambda value provides thereby how far the actually present air-fuel mixture deviates from the value $\lambda=1$, which is equivalent to a mass ratio of 14.7 kg air to 1 kg benzene that is theoretically necessary for a complete combustion, which means the lambda value is the quotient of the added air mass and the theoretical air demand. In the case of an air excess $\lambda$ equals 1 (lean mixture). In the case a fuel excess $\lambda$ is $<1$ (rich mixture).

During the lambda regulation each exhaust gas is basically measured and the added fuel amount and/or air amount is corrected correspondingly to the measuring result.

There are significant jumps in the lambda signal at the transition from boost operation into load operation at Otto engines, to which the suggested procedure mainly refers.

As sensors lambda probes are used, which can be constructed as a so-called two-point lambda probe or bistable probe on the one hand and as a continuous lambda probe or wide band lambda probe on the other hand. The effect of these lambda probes is based on the basically known principle of a galvanic oxygen concentration cell with a solid electrolyte. The characteristic line of a two-point lambda probe provides at $\lambda=1$ a jerky drop of the probe voltage. Therefore a two-point lambda probe, which is usually attached directly behind the exhaust manifold, allows basically only the distinction between rich and lean exhaust gas. A wideband lambda probe allows on the other hand the exact measurement of the lambda value in the exhaust gas in a wide range around $\lambda=1$. Both lambda probe types consist of a ceramic sensor element, a protection pipe, as well of cables, a plug and the connections between these elements. The protection pipe consists of one or several metal cylinders with openings. Through these openings exhaust gas enters by diffusion or convection and gets to the sensor element. The sensor elements of the two lambda probe types are thereby constructed differently.

A quick regulation of the exhaust gas composition on to the preset lambda value is significant for the low-emission operation of the combustion engine. This applies especially also for combustion engines with single cylinder regulation, at which the air-fuel mixture is adjusted individually for each single cylinder of the combustion engine on the basis of the signal of the common lambda probe. Therefore the lambda measurement has to take place with a high temporal resolution in order to be able to determine the consecutive exhaust gas volumes of the different cylinders in its composition that get to the lambda probe and to be able to assign them to a corresponding cylinder.

Besides the selected regulating parameters of the lambda control system and the distance parameters the dynamic of the lambda probe determines the speed of the control circuit. During restarting the dynamic of the lambda probes is thereby also sufficient for a single cylinder regulation with a common lambda probe in a common exhaust pipe for all cylinders. But due to ageing effects the dynamic characteristics of the lambda probes can change in such a way that the temporal resolution of the determination of the exhaust gas composition is not sufficient anymore, which causes an increased pollutant emission. If it lies outside the legal guidelines the lacking dynamic of the lambda probe has to be recognized in the range of the on-board diagnosis of the combustion engine and a corresponding error message has to be provided. In many countries the statutory provisions for motor vehicles require that such a diagnosis has to be implemented in the engine control unit, which turns on an error light at a slowing down of the lambda probes, which causes the exceeding of a default pollution threshold. In the USA the dynamic parameter that has to be monitored is précised as the so-called response-time, which means the time between a change of the oxygen or rich gas concentration in the exhaust gas at the probe and the corresponding change of the probe signal.

The state of the art knows a variety of diagnosing procedures, for example the comparison of the measured with an expected lambda signal at a known stimulation.

A procedure for diagnosing the dynamic characteristics of a lambda probe, which is used at least temporarily for a cylinder individual lambda regulation, as well as a corresponding diagnosing device are known for example from DE 102 60 721 A1. It is thereby provided that at least correcting variable of the lambda regulation is detected and compared to a default maximum threshold and is evaluated as not sufficient in the case of an exceeding of the maximum threshold of the dynamic behavior of the lambda robe with regard to the availability for the cylinder individual lambda regulation. The dynamic characteristics of the lambda probe can be detected from the single cylinder regulation itself because the cylinder individual regulators diverge at a not sufficient dynamic of the lambda probe. Furthermore a test function can be provided with a targeted interference or alienation of the actual lambda value. The procedure qualifies therefore only for combustion engines with a single cylinder lambda regulation or it requires a targeted influencing of the lambda value.

At present dynamic diagnoses usually single defined signal jumps are evaluated. An alternative procedure for diagnosing the dynamic of an exhaust gas probe provides that a simulated lambda value is calculated parallel to a lambda value that has been measured with the exhaust gas probe.

In order to be able to compare the calculated lambda value with the measured value also in dynamic driving operation, it is necessary to consider the gas travel time as well as the response behavior of the exhaust gas probe. A model exists therefore, which carries out a phase reverse rotation of the lambda value by a delay element of 1st order (PT1) and a dead time depending on the exhaust gas mass flow. The model parameters of this function are determined during the application and stored in the control unit. Thereby it can be ensured that the calculated and measured signals are in phase and therefore comparable.

This procedure requires a certain stability of the sensor behavior over lifetime. If the response behavior of the sensor changes, for example by depositing soot on the sensor element, the signal courses do not fit dynamically anymore. The result is that the application functions, which uses the simulated as well as the measured lambda signal, work with dynamically not matching input signals.

One application function is the so-called fuel mass observer (FMO), which is further described in a parallel application of the applicant. The fuel mass observer is a regulatory technical interference observer, which means an observer that is used for over-plugging disturbance variables. An observer is a model of the system that has to be regulated/controlled. This model distinguishes itself thereby that an output signal is compared to a measurement parameter of the real system. The difference between the simulated signal and the measured signal, the estimated error, are delivered back to the model inlet over a regulator. Thereby the model is regulated in such a way that the outlet behaves like the one of the real system.

Due to the above mentioned change of the response behavior big correcting variable deflections can occur during the FMO-output signal. The mixture is then for example made rich or lean at the wrong point of time. This has different effects from increased emissions up to component damages, for example due to increased exhaust gas temperatures at the turbo charger. This is only detected by a dynamic observation as it is already known from the state of art at an extreme change of the response behavior of the sensor. Only then the application functions can react upon it.

It is therefore the task of the invention to provide a procedure, which can detect in a deviation of the response behavior of the exhaust gas probe compared to the applied normal condition in the model behavior and which may correct it.

SUMMARY

The task of the invention that concerns the procedure is thereby solved that a jump behavior of the exhaust gas probe is determined during a running vehicle operation by evaluating a signal change at a stimulation of the system and that the dynamic model of the exhaust gas probe is adapted with the aid of these results. Such system stimulations can be ideally load-boost-transitions at diesel combustion engines, to which the procedure according to the invention mainly refers to. The procedure according to the invention serves for determining the actual response behavior of the exhaust gas probe and the correction of the model parameters of the calculated lambda value and therefore for improving the conformity of the measured with the modeled lambda value as long as this is still useful from the perspective of the application function. As soon as a useful tracking of the model parameters is not possible anymore the on-board diagnosis of the dynamic of the exhaust gas probe has to report an error. In contrast to the state of the art a gap can be thereby assumed between a normal condition with dynamic deviations that are tolerated by the application function and a real error condition with regard to the dynamic of the exhaust gas probe, which exists between the normal condition and the recognizable error condition. Thereby the useful signal can be improved in the range between the new part and the diagnosable bad part with regard to the tolerance. The calculation of correcting signals for the air- and injection system at diesel combustion engines can thereby be improved.

Because an impairment of the dynamic of the exhaust gas probe, for example by soot, is a typical long term effect, it is provided in a preferred procedure variant that several system stimulations are evaluated under similar conditions for adapting the dynamic model. Effort measurements, for example due to short interference effects for example when driving through a tunnel or due to high humidity, can be avoided due to the statistic if the data basis is based on preferably at least 10 to 100 system stimulations.

It is thereby advantageously if only defined system stimulations are evaluated, at which the measuring signal has been basically stationary before and after a system stimulation (for example after a load-boost-transition). Dynamic effects, which would interfere with the evaluation, are thereby purposely blanked out.

A preferred procedure variant provides that the evaluation results if the system stimulations are cataloged and/or filtered. Thereby this can take place according to specific criteria, as for example according to a exhaust gas mass flow, so that finally correcting values for model parameters of the dynamic model can be calculated from the cataloged and/or filtered evaluation results under consideration of all values in a mass current interval.

A tracking of the model parameters can thereby be carried out preferably continuously or indiscrete steps, whereby the initial values can be limited at the tracking.

A preferred application of the inventive procedure with its previously described variants provides the adaptation of the model parameters for optimizing a regulatory technical interference observer. Such an interference observer is for example the above described fuel mass observer (FMO). Therefore the calculated and the measured lambda value can especially be kept in phase as long as possible, so that the FMO and also other application functions are provided with the best possible input signal. It is thereby advantageously that the application functions can determine an accurate output signal, even if the probe shows a dynamical behavior that is deviating from the calculated lambda model value, for example by contaminating the sensor element. By using the invention advantages arise for the reduction of the emission scatterings and the component protection in particular at full load.

According to the invention it is provided that the learning values that have been determined by the application function are maintained during the application of the adaptation of the model parameters, as long as no dynamic error has been detected and/or shown yet for the exhaust gas probe. In the previous solutions with a firmly applied dynamic model the learning values of the FMO have to be reversed after detecting a dynamic error and changing the probe, because they have been adapted wrongly over a long period of time. With the use of the procedure according to the invention this is not absolutely necessary anymore.

Especially advantageously is the use of the procedure if the exhaust gas probe is a wideband lambda probe. In particular at these probe types the procedure provides advantages with regard to the dynamic diagnosis or at the adaptation of the dynamic model for the exhaust gas probe.

The task that concerns the device is thereby solved that a jump behavior of the exhaust gas probe can be determined with the aid of a program that is stored in the control unit and/or in the diagnostic unit during a running vehicle operation by evaluating a signal change at a stimulation of the system and that the dynamic model of the exhaust gas probe can be adapted with the aid of these results. The control unit or the diagnostic unit can thereby be for example a component of a superior engine control, for example at a diesel combustion engine the component of a electronic diesel control unit (EDC).

BRIEF DESCRIPTION OF THE DRAWINGS

The invention is subsequently further explained with the aid of the embodiment that is shown in the figures.

It is shown in:

FIG. 1 shows schematically a combustion engine with a control circuit for a lambda regulation, FIG. 2 shows schematically an adaptation procedure.

DETAILED DESCRIPTION

Figure 3:
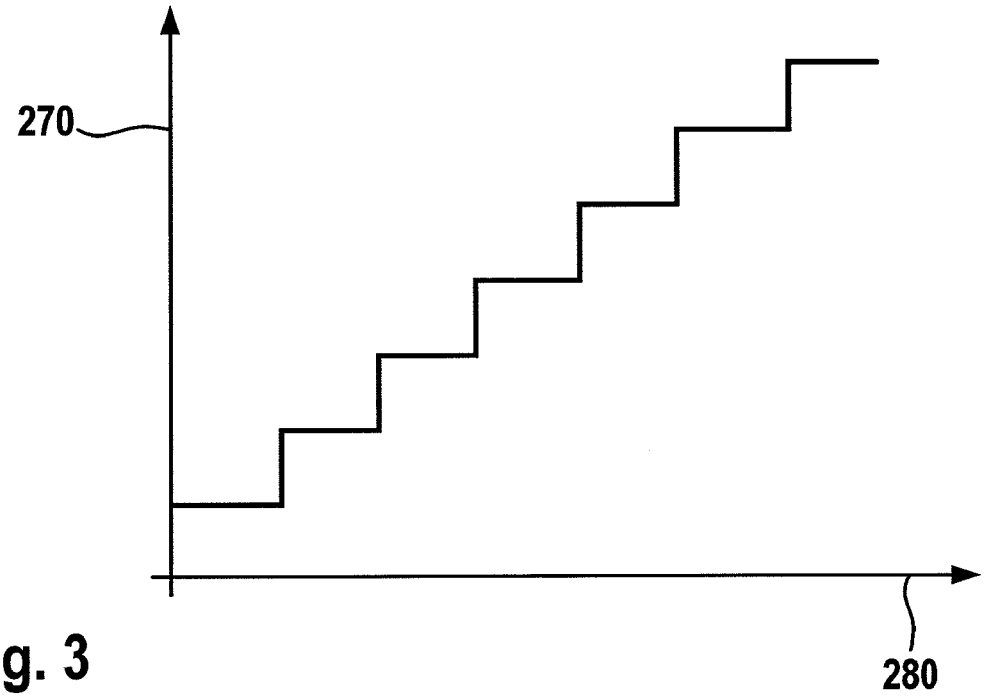
FIG. 3 shows a tracking possibility for model parameters and FIG. 4 shows an alternative tracking possibility for model parameters.

FIG. 1 shows an example of a technical environment, in which the procedure according to the invention can be applied. The illustration is limited thereby to the components that are necessary for the explanation of the invention.

The figure shows a combustion engine 1, in particular a diesel combustion engine, consisting of an engine block 40 and a supply air duct 10, which supplies the engine block 40 with combustion air, whereby the air amount in the supply air duct 10 can be determined with a supply air measuring device 20. The exhaust gas of the combustion engine 1 is thereby carried over an exhaust gas purification device, which provides an exhaust pipe 50 as its main component, in which in the direction of the flow of the exhaust gas a first exhaust gas probe 60 is arranged in front of a catalytic converter 70 and if necessary a second exhaust gas probe 80 behind the catalytic converter 70.

The exhaust gas probes 60, 80 are connected to a control unit 90, which calculates the mixture from the data of the exhaust gas probes 60, 80 and the data of the supply air measuring device 20 and which controls a fuel metering device 30 for metering fuel. Coupled with the control unit 90 or integrated into it is a diagnostic unit 100, with which the signals of the exhaust gas probes 60, 80 can be evaluated. The diagnostic unit 100 can furthermore be connected with the display-/storage unit, which is here not shown.

A lambda value, which is suitable for the exhaust gas purification device for achieving an optimal purification effect, can be adjusted by the exhaust gas probe 60 that is arranged behind the engine block 40 with the aid of the control unit 90. The second exhaust gas probe 80 that is arranged in the exhaust pipe 50 behind the catalytic converter 70 and that is typical for Otto combustion engines can also be evaluated in the control unit 90, and serves for determining the oxygen capacity of the exhaust gas purification device in a procedure according to the state of the art. For diesel combustion engines the first exhaust gas probe 60 is used for adapting an exhaust gas recirculation (AGR) and the injections.

Exemplarily a combustion engine 1 is shown here, which provides only one exhaust pipe 50. The procedure according to the invention also extends to combustion engines 1 with multiple bank exhaust gas systems, in which the cylinders are comprised in several groups and in which the exhaust gas of the different cylinder groups is introduced in separated exhaust pipes 50, in which at least one exhaust gas probe 60 is built in.

The procedure extends also to the case that further exhaust gas probes, for example as it is shown in FIG. 1 exhaust gas probe 80, are built in with regard to the exhaust gas current upstream or downstream of the considered exhaust gas probe 60. But primarily the procedure aims at the first lambda probe in the direction of the flow behind the outlet valves in the combustion engine that is used for the lambda regulation. In the present embodiment the exhaust gas probe 60 is construed as wideband lambda probe (or LSU-probe).

FIG. 2 schematically shows an adaptation procedure 200 according to the invention in a block illustration, as it can be for example integrated in the control unit 90 or the diagnostic unit 100 of the combustion engine 1, whereby the functionality is preferably implemented in the form of a software.

The function is based on the online determination of a signal response behavior of the exhaust gas probe 60 during running operation. Therefore dynamic transitions, for example load changes, load-boost-transitions, in particular at diesel combustion engines, or other dynamic stimulations of the probe signal are evaluated. This takes place in the block detection of the jump response 210 and in the block evaluation of the jump response 220, whereby only values are used for the processing, which comply with certain conditions 215. Thus for example only measuring values of so-called "valid" load-boost-transitions enter, at which it has been evaluated whether the measuring signal has been sufficiently stationary before and after the load-boost-transition.

In contrast to the dynamic observation of the exhaust gas probe 60, as it is implemented in previous control or diagnostic units 90 or 100 of combustion engines 1, very many, typically at least 10 to 100 load-boost-transitions are considered at the procedure according to the invention under similar conditions. Therefore the results of the jump responses are collected and sorted into categories in the block cataloging/signal filtering 230 according to specific criteria 235. The main criteria can thereby be the exhaust gas mass flow because the response behavior of the exhaust gas probe 60 and the gas travel time do mainly depend on this parameter.

If a sufficiently big data basis is determined, the calculation takes place in the block calculation learning result 240 and evaluation learning result 250 and the adaptation of the dynamic model in the block correction of the model parameters 260 under consideration of all detected values in one mass current interval.

Figure 4:
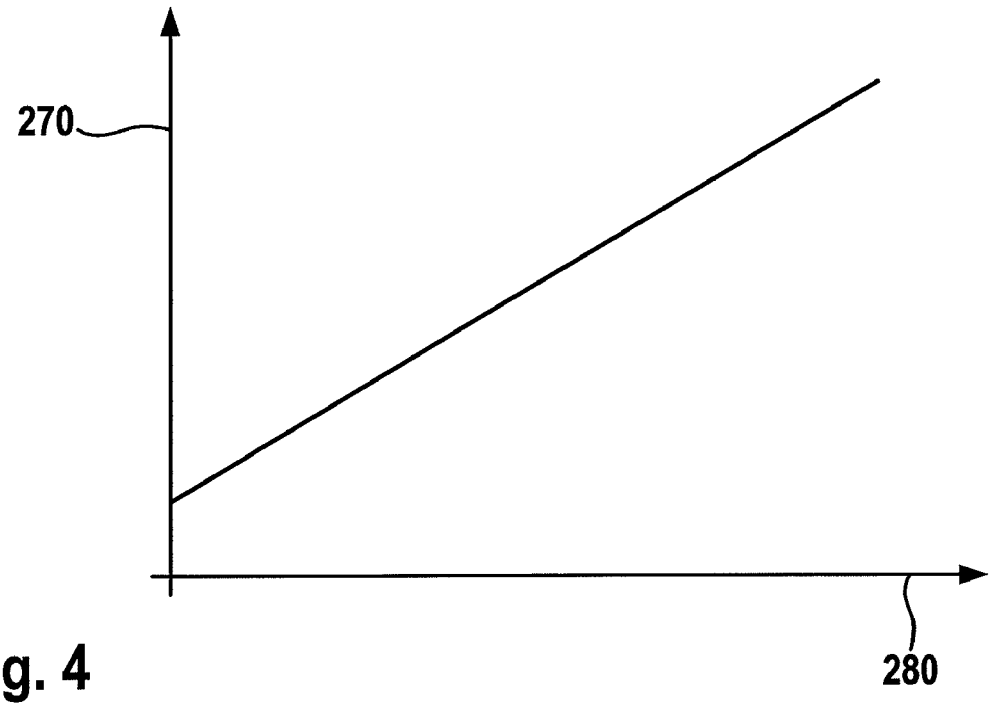

As FIG. 3 shows a tracking possibility for the model parameters 270 can take place in discrete steps or as FIG. 4 shows continuously depending on system defaults 280. Diverse types of limitations of the output values of the function can be also used.

The invention serves the determination of the actual response behavior of the exhaust gas probe and the correction if the model parameters of the calculated lambda values, and therefore for improving the compliance of the measured and modeled lambda values, as long as it seems to be useful from the perspective of the application function. Like it has been described the procedure according to the invention and the device can be used at diesel combustion engines, but also at Otto engines, mixed forms between Otto and diesel engines, combinations of different drives, so-called hybrids, or at gas engines.

The invention claimed is:

1. A method of adapting a dynamic model of an exhaust gas probe, wherein the exhaust gas probe is a component of an exhaust pipe of an exhaust gas system of a combustion engine, the method comprising:

measuring a lambda value with the exhaust gas probe for regulating an air-fuel composition;

calculating a simulated lambda value in parallel to that in a control unit or in a diagnostic unit of the combustion engine, wherein an application function uses the simulated and the measured lambda value; and determining a jump behavior of the exhaust gas probe during a running vehicle operation by evaluating a signal change at a stimulation of the system, wherein the dynamic model of the exhaust gas probe is adapted with the aid of the results.

2. The method of claim 1, further comprising evaluating a plurality of system stimulations under similar conditions for an adaptation of the dynamic model.

3. The method of claim 2, further comprising evaluating only defined system stimulations wherein a measuring signal has been basically stationary before and after the system stimulation.

4. The method of claim 1, further comprising cataloging and/or filtering evaluation results of the system stimulations.

5. The method of claim 4, further comprising calculating correcting values for model parameters of the dynamic model from cataloged and/or filtered evaluation results under consideration of all detected values in a mass current interval.

6. The method of claim 5, further comprising continuously tracking the model parameters.

7. The method of claim 5, further comprising tracking the model parameters in discrete steps.

8. The method of claim 6, wherein tracking the model parameters are limited with regard to its output signals.

9. The method of claim 1, further comprising using the adaptation of the model parameters for optimizing a regulating technical interference monitor.

10. The method claim 1, further comprising keeping learning values that have been determined by the application function at the application of the adaptation of the model parameters until no dynamic error for the exhaust gas probe is detected and/or shown.

11. The method claim 1, further comprising using a wideband lambda probe as the exhaust gas probe.

12. A device configured to implement a method of adapting a dynamic model of an exhaust gas probe, wherein the exhaust gas probe is a component of an exhaust pipe of an exhaust gas system of a combustion engine, the method comprising: measuring a lambda value with the exhaust gas probe for regulating an air-fuel composition; calculating a simulated lambda value in parallel to that in a control unit or in a diagnostic unit of the combustion engine, wherein an application function uses the simulated and the measured lambda value; and determining a jump behavior of the exhaust gas probe during a running vehicle operation by evaluating a signal change at a stimulation of the system, wherein the dynamic model of the exhaust gas probe is adapted with the aid of the results.

* * * * *